US006648690B2

(12) United States Patent
Saito et al.

(10) Patent No.: US 6,648,690 B2
(45) Date of Patent: Nov. 18, 2003

(54) TERMINAL END STRUCTURE FOR SHIELDED WIRE

(75) Inventors: Satoshi Saito, Shizuoka (JP); Tomohiro Ikeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/046,074

(22) Filed: Jan. 16, 2002

(65) Prior Publication Data

US 2002/0106918 A1 Aug. 8, 2002

(30) Foreign Application Priority Data

Jan. 17, 2001 (JP) ..... P2001-009382

(51) Int. Cl.[7] ..... H01R 9/03
(52) U.S. Cl. ..... 439/610; 439/98; 439/99
(58) Field of Search ..... 439/610, 98, 99

(56) References Cited

U.S. PATENT DOCUMENTS 5,232,380 A * 8/1993 Inoue et al. ..... 439/585
5,954,542 A * 9/1999 Wu et al. ..... 439/584
5,965,847 A * 10/1999 Tanaka et al. ..... 174/84 R
6,107,572 A * 8/2000 Miyazaki ..... 174/75 C
6,203,375 B1 * 3/2001 Chang ..... 439/465
6,206,727 B1 * 3/2001 Aoyama et al. ..... 439/424
6,398,563 B1 * 6/2002 Kanagawa et al. ..... 439/587

* cited by examiner

*Primary Examiner*—P. Austin Bradley
*Assistant Examiner*—Edwin A. León
(74) *Attorney, Agent, or Firm*—Sughrue Mion, PLLC

(57) ABSTRACT

A shield terminal, having a cylindrical shape, is so designed that brackets for connecting a rectangular plate to a grounding cable are formed at both side ends of the rectangular plate, and a shielded wire is enclosed by bringing the inner faces of the brackets into alignment. Then, a braided shield of the shielded wire, which is exposed from the shield terminal, is folded over the outer wall of the shield terminal. Further, a caulking ring is fitted over the braided shield and securely engages the outer wall of the shield terminal, and the portion whereat both side ends of the shielded wire are aligned has a cross-stitch shape.

6 Claims, 7 Drawing Sheets

TERMINAL END STRUCTURE FOR SHIELDED WIRE

CROSS REFERENCE TO THE RELATED APPLICATION

The present invention is based on Japanese Patent Application No. 2001-9382, the entire contents of which are incorporated herein by reference.

BACKGROUND OF THE INVENTION

1. Field of the Invention

The present invention relates to a grounding method of a braided wire for electromagnetic wave shielding by folding the braided wire over and covering the terminal end of the shielded wire with a cylindrical shield terminal as well as securely caulking around the circumference of the shielded wire in order to ensure adequate electrical conductivity. In particular, the present invention relates to a shielded wire terminal end structure that provides stable electrical conductivity.

2. Related Art

Generally, various terminal end structures are employed to ground a shielded wire for which electromagnetic wave braided shielding is employed. Conventionally, the method shown in FIGS. 4 to 6 is employed to stabilize the conduct of electricity.

As is shown in FIG. 4, for a grounding connection, a terminal process is performed for a shielded wire 1. That is, for the shielded wire 1, a conductive member 2 is surrounded by an insulating member 3 covered by a braided shield 4, which is woven to form a mesh-like structure of intertwined conductive lines, over which a sheath 5 is fitted. The thus arranged S shielded wire 1 is connected to a box as is shown in FIG. 5. That is, first, the braided shield 4 is exposed by peeling the sheath 5 off the terminal end of the shielded wire 1, then, portions of the exposed distal end of the braided shield 4 and the insulating member 3 are peeled off to expose the conductive member 2.

A shield terminal 6 is then attached to the thus prepared shielded wire 1, and the braided shield 4 of the shielded wire 1 is connected to the shield terminal 6. As is shown in FIG. 6, formed at one end on opposite sides of a rectangularly shaped plate 7 of the shield terminal 6 are brackets 9 and 11 in which are respectively provided holes 8 and 10, through which a screw can be inserted to secure the bracket 9 to the seat (not shown) of a box. Grounding of the holes 8 and 10 can also be accomplished by the connection to them of a ground line (not shown).

Finally, to form the shield terminal 6, the shielded wire 1 is positioned on the plate member 7, between the brackets 9 and 11, so that one end of the shield terminal 6 corresponds to the distal end of the sheath 5. Then, the shielded wire 1 is enclosed in the plate 7 by raising the brackets 9 and 11 at both side ends, so that the end of the plate 7 of the shield terminal 6 abuts upon the shielded wire 1. At this time, the inner faces of the brackets 9 and 11 are aligned, and thereafter, the braided shield 4 of the shielded wire 1 is folded back around the outer wall of the shield terminal 6. A caulking ring 12 is then fitted over the folded, braided shield 4, and is caulked to press the braided shield 4 against the outer wall of the shield terminal 6.

After the attachment of the shield terminal 6 to the shielded wire 1 has been effected, the shielded wire 1 is secured to the seat on the box by inserting a screw through the holes 8 and 10 of the shield terminal 6 and rotating the screw to engage a threaded hole in the box or by inserting a grounding line (not shown) through the holes 8 and 10 of the shield terminal 6. In this manner, an external electric connection is established for the braided shield 4 of the shielded wire 1.

When the shielded wire 1 is enclosed and the inner face of the bracket 9 of the shield terminal 6 is aligned with the inner face of the bracket 11, a slit 14 is defined at the portion whereat the side end of the plate 7 of the shield terminal 6 is abutted. This slit 14 is narrowed when the braided shield 4 of the shielded wire 1 is folded over the outer wall of the shield terminal 6 and a caulking ring 12 is fitted over the folded braided shield 4 and is securely caulked, as is shown in FIG. 7. Then, one part of the plate 7 at the end face covers the other part, and thus, an overlapped portion 13 is formed. At this time, since the brackets 9 and 11 are extended perpendicular to the plate 7, i.e., in the horizontal direction, the slit 14 is positioned at the vertex of the caulked shape.

In addition, since the braided shield 4 of the shielded wire 1 is folded over the outer face of the shield terminal 6, and the caulking ring 12 is fitted over the braided shield 4 and then caulked, the pressure is applied only to one end of the plate 7 of the shield terminal 6, and the gap is removed only on the side nearest the caulking ring 12. As a result, as is shown in FIG. 10, as the caulking ring 12 is caulked, the overlapped portion 13 is formed at the other end of the plate 7.

Therefore, the shape of the caulked portion is such that it is weakened, and may be vulnerable to the application of an external load (because only one side of the caulked portion is pressed down). And when the overlapped portion 13 is formed, whereat one side of the end covers the other, the slit 14 is concentrated at the portion whereat the braided shield 4 of the shielded wire 1 is folded for insertion, and at this portion, the braided shield 4 may be severed. In addition, if the slit 14 is defined when the inner faces of the bracket 9 and the bracket 11 of the shield terminal 6 are brought together, and the gap between the sides at that end of the plate 7 of the shield terminal 6 is not reduced, the pressure produced by the caulking will not be distributed across the braided shield 4 of the shielded wire 1, and a stable caulked portion will not be obtained.

SUMMARY OF THE INVENTION

It is, therefore, an objective of the present invention to provide a terminal end structure for a shielded wire cable that ensures that after caulking no slit remains between the side end faces of the shield terminal, and that one side end face of the shield terminal does not ride up over.

To achieve the above objective, according to a first aspect of the invention, provided is a terminal end structure wherein a shielded wire is enclosed therein comprising: a shield terminal having a bracket for grounding at a side thereof, the shield terminal being formed in a cylindrical shape from a plate; a braided shield being exposed from the shielded wire, and folded over an outer wall of the shield terminal; a caulking ring fitted over the braided shield and securely retaining the outer wall of the shield terminal; and wherein a portion whereat both side ends of the shield terminal are aligned has a non-linear shape.

Preferably the portion whereat both side ends of the shield terminal are aligned may include at least one tongue formed in one of the side ends of the shield terminal, and opposing to at least one indented portion formed in another of the side ends of the shield terminal.

According to the first aspect of the invention, with this arrangement, after caulking has been performed, no slit is defined between the end faces of the shield terminal, so that one side end face of the shield terminal can be prevented from riding up and over.

Further, to achieve the object of the invention, according to a second aspect of the terminal end structure for the shielded wire, wherein the tongue and the indented portion are formed in each of the side end of the shield terminal, lengths of the tongues formed in both side ends are substantially the same.

According to the second aspect, with this arrangement, after caulking has been performed, no slit is defined between the side end faces of the shield terminal, so that one side end face of the shield terminal can be prevented from riding up over.

In addition, to achieve the objective of the invention, according to a third aspect of the terminal end structure for the shielded wire, wherein the caulking ring is caulked over the braided shield folded, so that the caulking ring is securely pressed against the outer wall of the shield terminal.

According to the third aspect, with this arrangement, after caulking has been performed, no slit is defined between the end faces of the shield terminal, so that one end face of the shield terminal can be prevented from riding up over.

DETAILED DESCRIPTION OF THE PREFERRED EMBODIMENTS

A terminal end structure for a shielded wire will now be described in detail according to one embodiment of the present invention.

Figure 1:
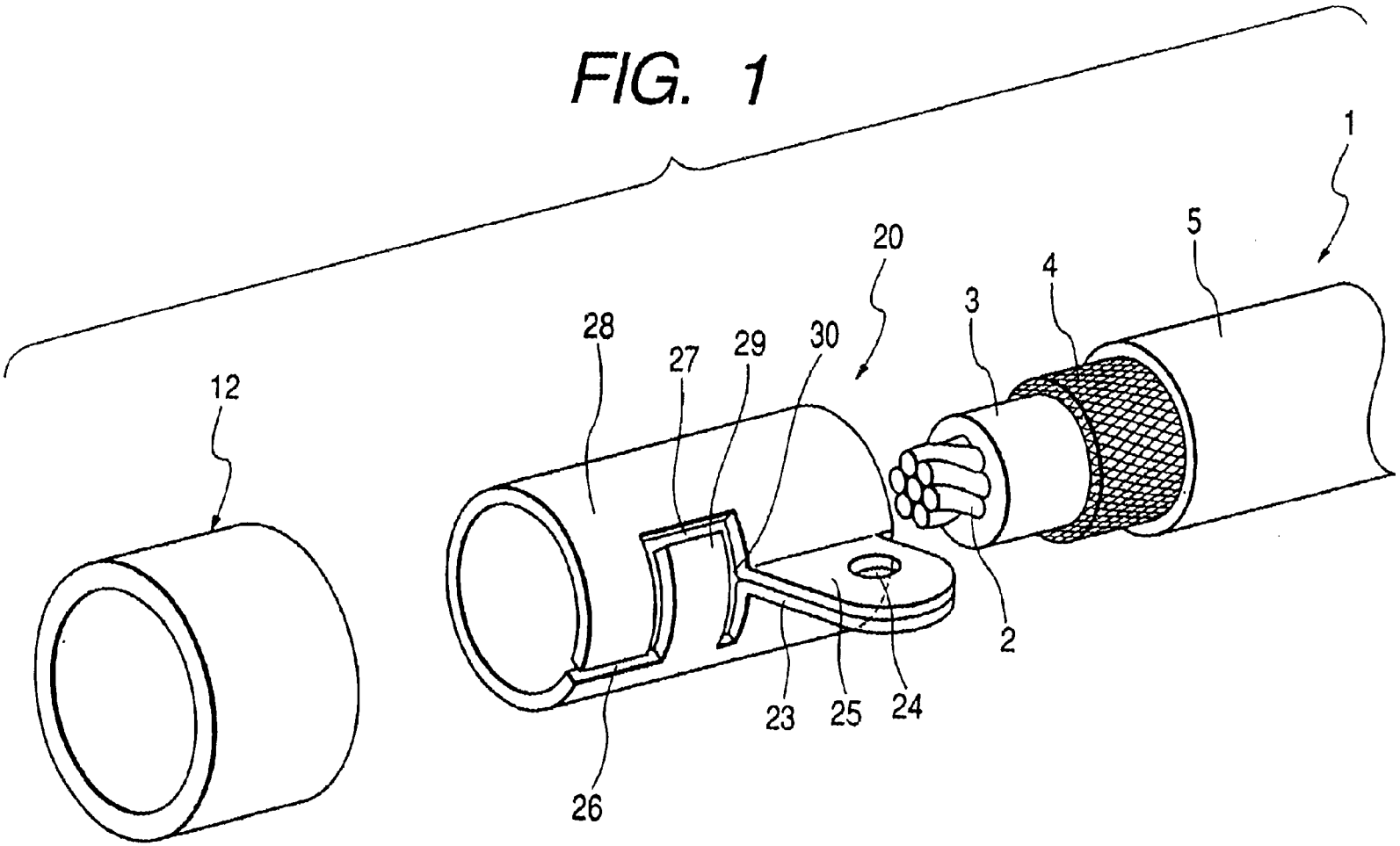
FIG. 1 is an exploded perspective view of the assembly of a terminal end structure for a shielded wire according to one embodiment of the present invention.
Figure 2:
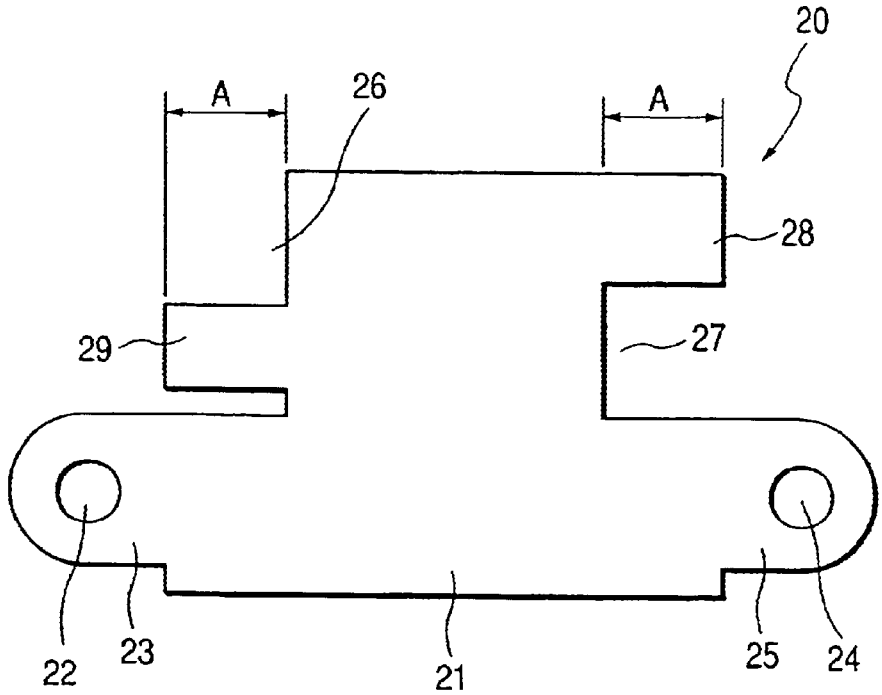
FIG. 2 is a plan view of a shield terminal in FIG. 1.
Figure 3:
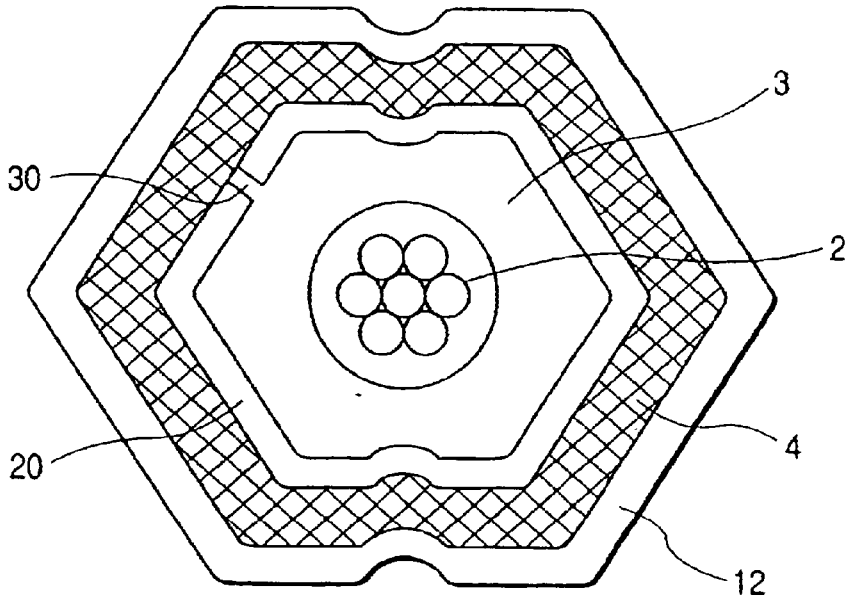
FIG. 3 is a cross-sectional view of a case wherein the shield terminal in FIG. 2 has been assembled.
Figure 4:
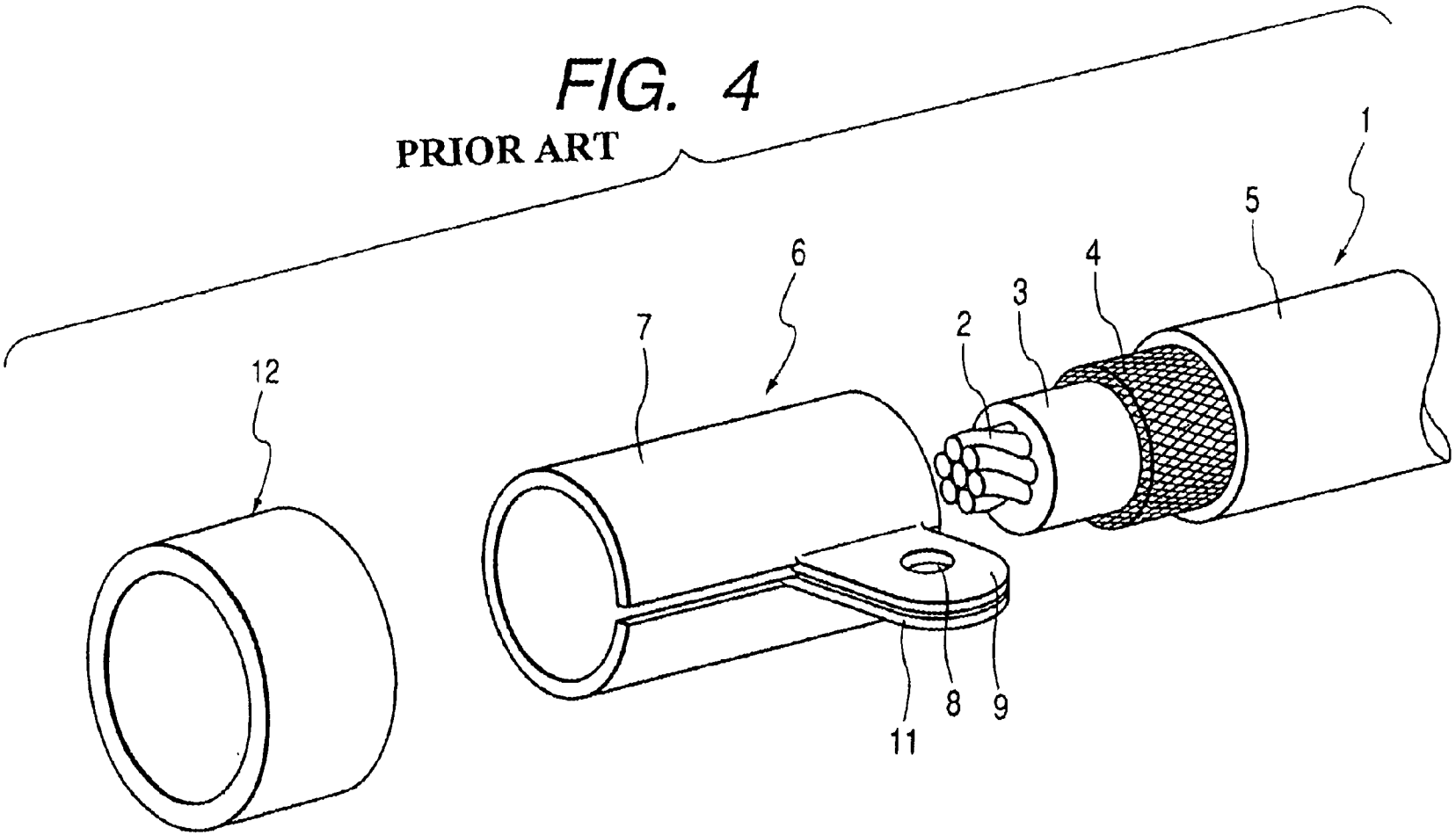
FIG. 4 PRIOR ART
FIG. 4 is an exploded perspective view of the assembly of a conventional terminal end structure for a shielded wire.
Figure 5:
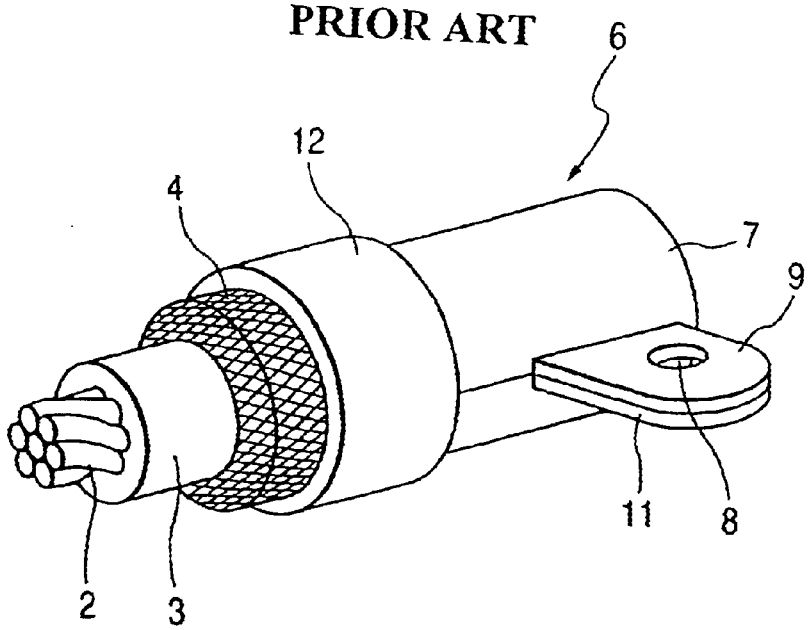
FIG. 5 PRIOR ART
FIG. 5 is a perspective view of the assembly of the terminal end structure in FIG. 4.
Figure 6:
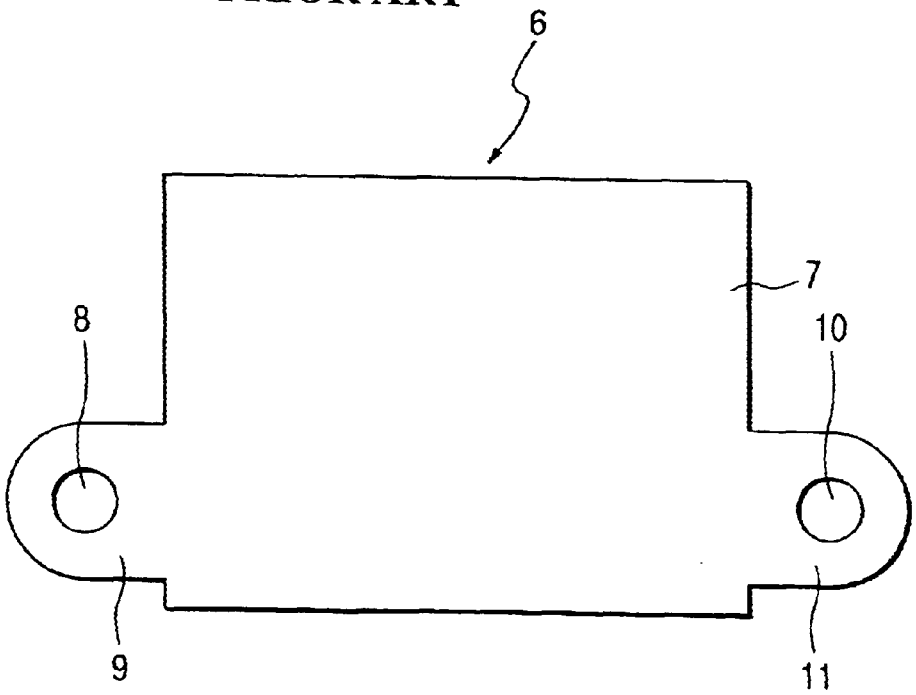
FIG. 6 PRIOR ART
FIG. 6 is a plan view of a shield terminal in FIG. 4.
Figure 7:
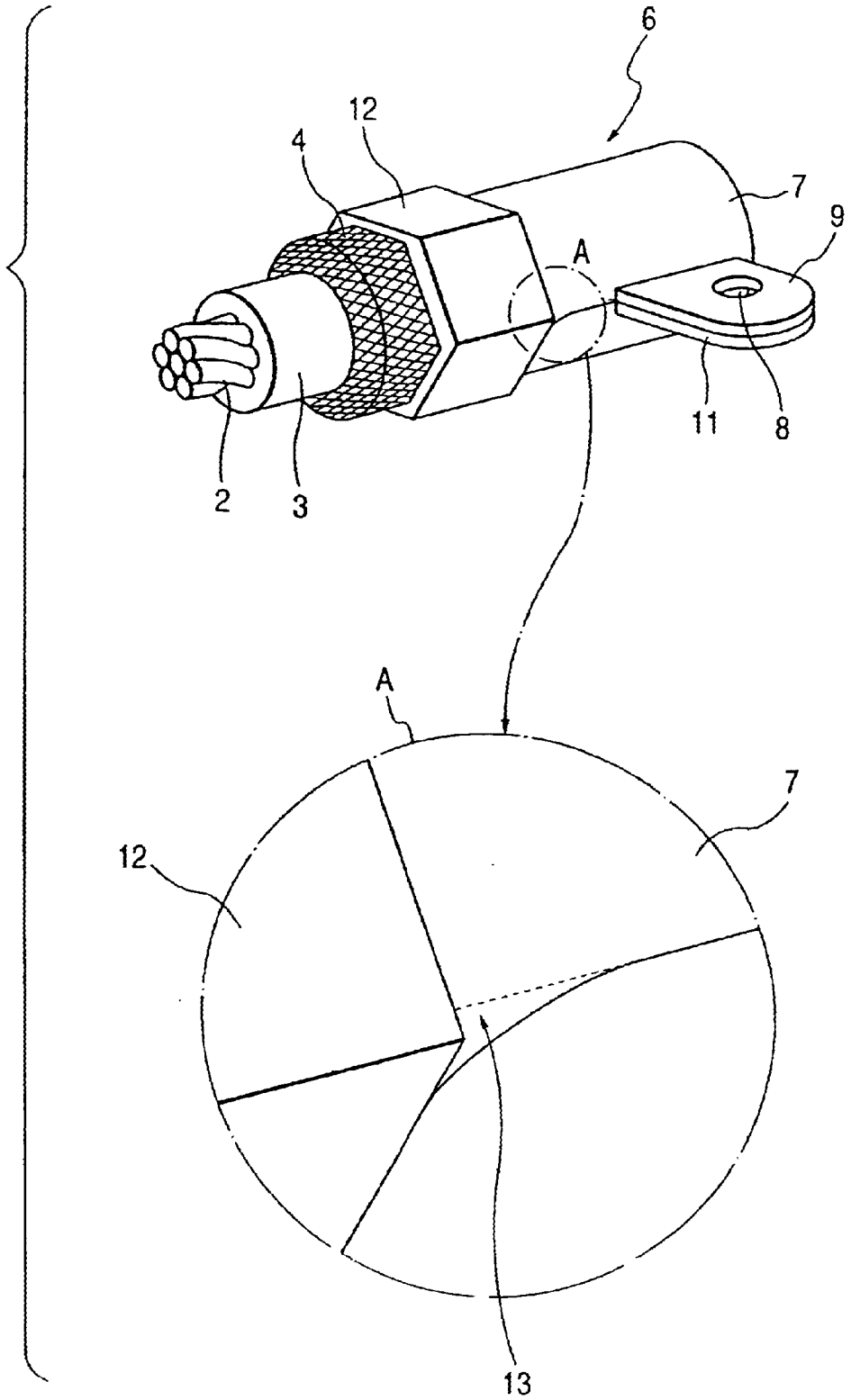
FIG. 7 PRIOR ART
FIG. 7 is a perspective view of the caulked state of the terminal end structure for the shielded wire in FIG. 5.
Figure 8:
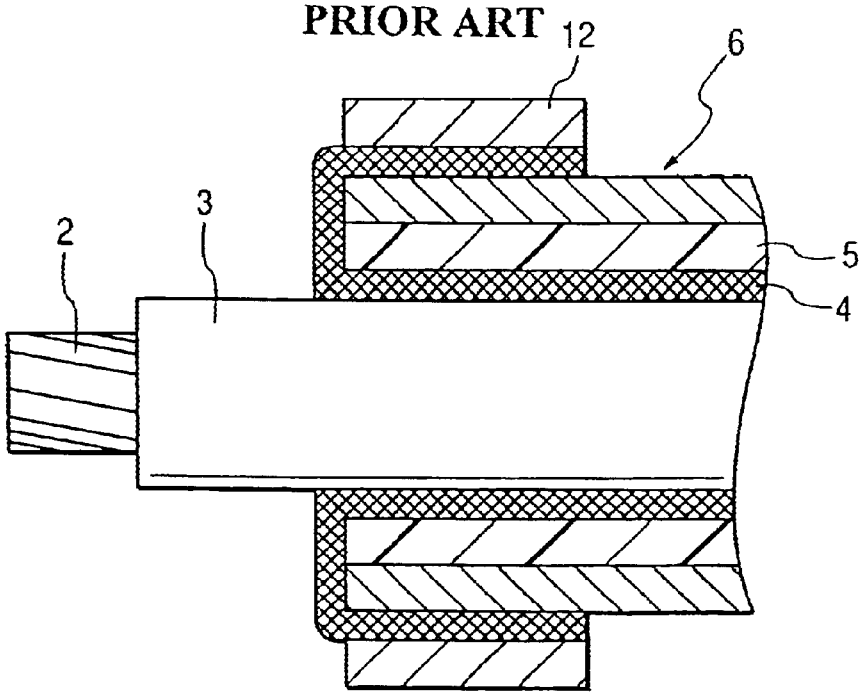
FIG. 8 PRIOR ART
FIG. 8 is a vertical cross-sectional view of the caulked state of the terminal end structure for the shielded wire in FIG. 7.
Figure 9:
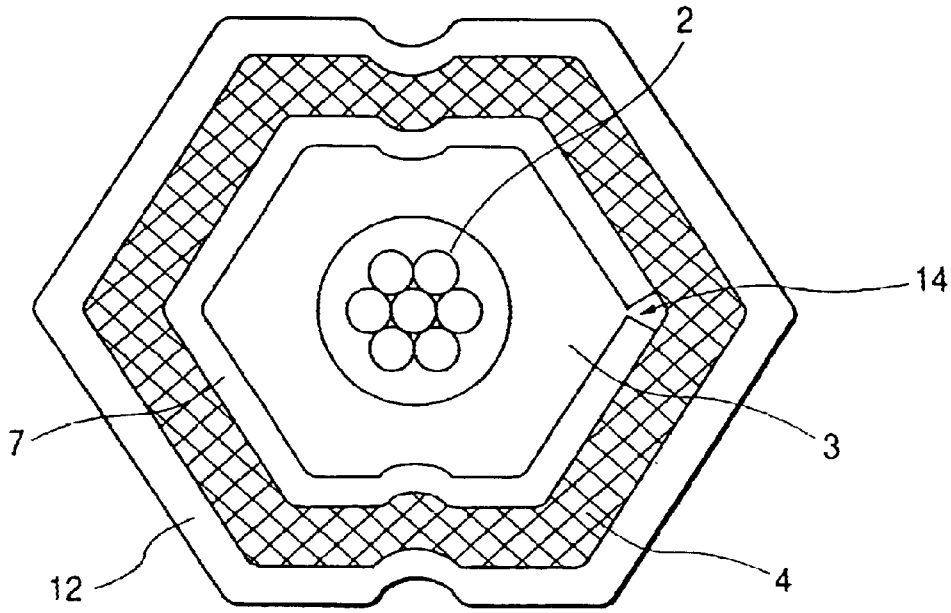
FIG. 9 PRIOR ART
FIG. 9 is a horizontal cross-sectional view of the caulked state of the terminal end structure for the shielded wire in FIG. 8.
Figure 10:
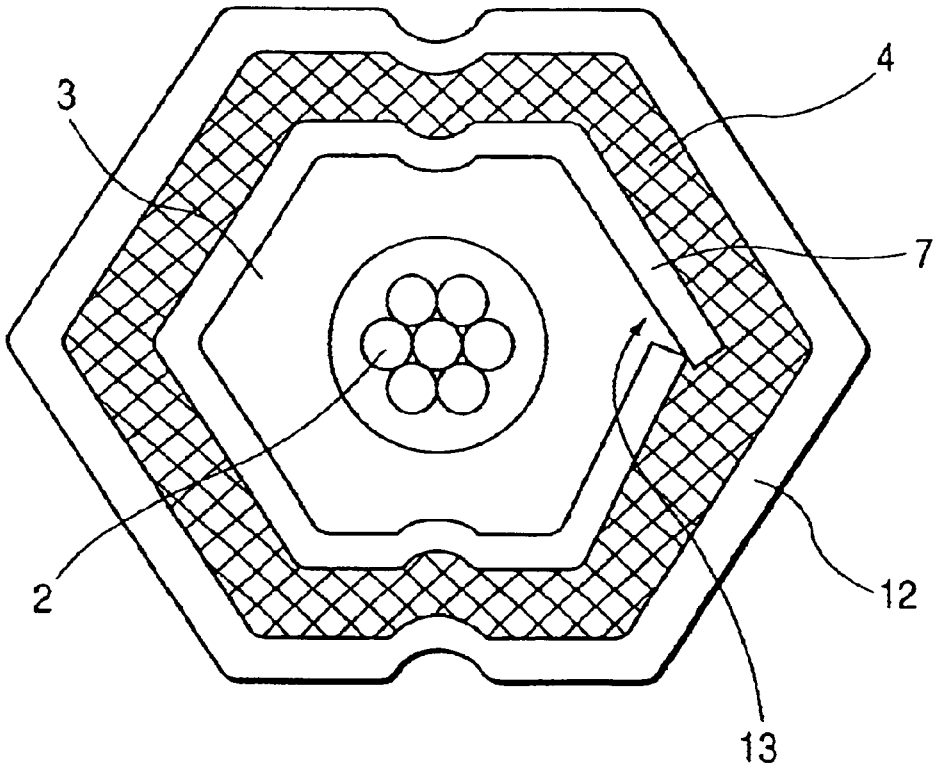
FIG. 10 PRIOR ART
FIG. 10 is a horizontal cross-sectional view of the state wherein the terminal end structure for the shielded wire in FIG. 8 has been caulked and one side end face of the shield terminal rides up over the other.

FIG. 1 is an exploded perspective view of the terminal end structure for a shielded wire according to the invention, FIG. 2 is a plan view of a shield terminal used for the terminal end structure for the shielded wire of the invention, and FIG. 3 is a cross-sectional view of the terminal end of the shielded wire for which the processing using the shield terminal is performed.

The same reference numerals as are used for FIGS. 1 to 3 are also used to denote corresponding components in FIGS. 4 to 10.

In FIG. 1, the terminal process for a grounding connection is performed for the terminal end of the shielded wire 1. That is, to assemble the shielded wire 1, an insulating member 3 is coated on a conductor 2, a braided shield 4, composed of a conducive mesh, is fitted over the insulating member 3, and a sheath 5 is applied over the braided shield 4.

To connect the thus assembled shielded wire 1 to a case, first, the braided shield 4 is exposed by peeling the sheath 5 off the terminal end of the shielded wire 1, and then, the conductor 2 is exposed by peeling off portions of the distal ends of the braided shield 4 and the insulating member 3.

A shield terminal 20 is then fitted over the thus prepared shielded wire 1, and is connected to the braided shield 4 of the shielded wire 1. The structure of the shield terminal 20 is as shown in FIG. 2. That is, a bracket 23, in which is provided a hole 22 through which a screw is inserted to secure the shield terminal 20 to the seat (not shown) on the case, is formed at one side end of a rectangular plate 21, and a bracket 25, in which is provided a hole 24 though which the screw is inserted to secure the shield terminal 20 to the seat (not shown) on the case, is formed on the opposite side end.

An indented portion 26 is formed in the side end of the plate 21 on the bracket 23 side, while an indented portion 27 is formed in the side end of the plate 21 on the bracket 25 side. To engage the indented portion 26, a tongue 28 is formed on the side end opposite the indented portion 26 formed in the plate 21 of the shield terminal 20, and to engage the indented portion 27, a tongue 29 is formed on the side end opposite the indented portion 27 formed in the plate 21 of the shield terminal 20.

Therefore, for the positioning relationship between the indented portion 26 and the tongue 28 and between the indented portion 27 and the tongue 29, as is shown in FIG. 1, when rounding of the shield terminal 20 is performed to obtain a cylindrical shape, and the inner faces of the brackets 23 and 25 are aligned, the tongue 28 engages the indented portion 26 and the tongue 29 engages the indented portion 27.

As is described above, when the shield terminal 20 is formed to obtain a cylindrical shape, at the portion whereat the side ends of the plate 21 are aligned, a slit 30 is formed. This slit 30 is non-linear, and in the embodiment, is formed in a zigzag like or stepped manner. Of course, depending on the shapes of the tongue 28, 29 and the indented portions 26, 27, other shapes of slit may be formed. The height (length) A of the tongue 28 is the same as the height (length) A of the tongue 29, for if the height (length) A of the tongue 28 is not the same as the height (length) A of the tongue 29, the faces of the brackets 23 and 25 can not coincide with each other. And further, if the height (length) A of the tongue 28 is the same as the height (length) A of the tongue 29, the same load can be applied to the tongues 28 and 29. When the tongue 28 rides up, accordingly, the other tongue 29 also rides up, but twice the load needed for the conventional shield terminal 6 is required, and substantially, it is possible to prevent one side end face of the shield terminal 20 from riding up over after the caulking has been completed. Further, since a large load is required to bend the tongues 28 and 29 at their roots, while only a small load is required to bend the distal ends of the tongues 28 and 29, a constant load can be imposed on the braided shield 4 of the shielded wire 1. Therefore, substantially, it is possible to prevent the braided shield 4 from being cut by the end face of the shield terminal 20 after the caulking has been completed.

Since the distal ends of the tongues 28 and 29 are bent inward, after the caulking, a slit is defined at the distal end of the tongue 29. However, because of the tongue 28, the braided shield 4 of the shielded wire 1 can be floated over the slit like a bridge. Thus, the braided shield 4 of the shielded wire 1 can be held and pressure can be applied thereto.

Since the zigzag like slit 30, the width of which is constant, is defined at the portion whereat the two side ends of the plate 21 abut when the shield terminal 20 is formed to obtain the cylindrical shape, and since a large load is required for the side end faces to ride up, riding up seldom occurs. Further, since because of its zigzag like shape the slit 30 that still remains can be held so that its width is constant, there is no portion of the braided shield 4 to which the stress produced by the caulking is not applied, and a stable caulked portion can be obtained.

The shielded wire 1 is placed on the plate 21 between the brackets 23 and 25, so that the end of the shield terminal 20 is opposite the distal end of the sheath 5. Then, the shielded wire 1 is enclosed in the plate 21 by raising the brackets 23 and 25 at the side ends, so that the side ends of the plate 21 of the shield terminal 20 are aligned. At this time, the inner faces of the brackets 23 and 25 are brought into contact, and thereafter, the braided shield 4 of the shielded wire 1 can be folded over the outer wall of the shield terminal 20. The caulking ring 12 is then fitted over the braided shield 4, and is caulked to press the braided shield 4 against the outer wall of the shield terminal 20. The state attained when the braided shield 4 is pressed against the outer wall of the shield terminal 20 by caulking the caulking ring 20 is shown in FIG. 3.

The shielded wire 1, to which the shield terminal 20 is attached and for which the terminal process is performed, is attached to the seat on the case by respectively inserting a screw through the holes 22 and 24 in the brackets 23 and 25 of the shield terminal 20 and engaging threads in the case. Or a grounding line (not shown) is respectively inserted through the holes 22 or 24 in the brackets 23 and 25 of the shield terminal 20, and an electrical connection between the braided shield 4 of the shielded wire 1 and the outside is established.

Since the slit 30 is defined zigzag like or stepped manner at the portion whereat the side ends of the plate 21 are aligned when the shield terminal 20 is formed to obtain a cylindrical shape, it is possible to remove the gap between the end faces of the shield terminal 20 after the caulking ring 12 has been fitted and caulked.

Further, since as is described above the slit 30 is defined zigzag like or stepped manner at the portion whereat the side ends of the plate 21 are aligned when the shield terminal 20 is formed to obtain a cylindrical shape, it is possible to prevent one side end face of the shield terminal 20 from riding up over the other after the caulking ring 12 has been fitted and caulked.

As is also described above, the slit 30 is defined zigzag like or stepped manner at the portion whereat the side ends of the plate 21 are aligned when the shield terminal 20 is formed to obtain a cylindrical shape, and the resistance of the caulked portion is stabilized between a minimum value of 0.021 m V/A and a maximum value of 0.066 m V/A, compared with the conventional resistance for which a minimum value of 1.0 m V/A and a maximum value of 0.083 m V/A is provided. Furthermore, since the slit 30 is defined zigzag like or stepped manner at the portion whereat the side ends of the plate 21 are aligned when the shield terminal 20 is formed to obtain a cylindrical shape, the bonding force of the caulked portion is stabilized between a minimum value of 415 N and a maximum value of 530 N, compared with the conventional force for which a minimum value of 420 N and a maximum value of 683 N is provided. In addition, since when the shield terminal 20 is formed to obtain a cylindrical shape the slit 30 is defined zigzag like or stepped manner at the portion whereat the side ends of the plate 21 are aligned and the brackets 23 and 25 are secured to the seat on the case, the bent state of the caulked portion can be stabilized. Moreover, since the slit 30 is defined zigzag like at the portion whereat the side ends of the plate 21 are aligned when the shield terminal 20 is formed to obtain a cylindrical shape, the shielding effect can be increased.

Since the thus described structure is provided for the invention, the following effects can be obtained.

According to the first aspect of the terminal end structure for the shielded wire, the gap is removed between the facing side ends of the shield terminal after the shield terminal is caulked, and one side end face of the shield terminal can be prevented from riding up over the other side end face.

According to the second aspect of the terminal end structure for the shielded wire, the gap is removed between the facing side ends of the shield terminal after the shield terminal is caulked, and one side end face of the shield terminal can be prevented from riding up over the other side end face.

According to the third aspect of the terminal end structure for the shielded wire, the gap is removed between the facing side ends of the shield terminal after the shield terminal is caulked, and one side end face of the shield terminal can be prevented from riding up over the other side end face.

What is claimed is:

1. A terminal end structure wherein a shielded wire is enclosed therein comprising:

a shield terminal having a bracket for grounding at a side thereof, said shield terminal being formed in a cylindrical shape from a plate;

a braided shield being exposed from said shielded wire, and folded over an outer wall of said shield terminal;

a caulking ring fitted over said braided shield and securely retaining the outer wall of said shield terminal; and wherein a portion of both side ends of said shield terminal align and engage in a non-liner manner.

2. A terminal end structure according to claim 1, wherein said caulking ring is caulked over said braided shield folded, so that said caulking ring is securely pressed against the outer wall of said shield terminal.

3. A terminal end structure according to claim 1, wherein the portion whereat both side ends of said shield terminal are aligned includes at least one tongue formed in one of said side ends of said shield terminal, and opposing to at least one indented portion formed in another of said side ends of said shield terminal.

4. A terminal end structure according to claim 3, wherein said tongue and said indented portion have a substantially rectangular shape.

5. A terminal end structure for the shielded wire according to claim 3, wherein said tongue and said indented portion are formed in each of said side end of said shield terminal, lengths of said tongues formed in both side ends are substantially the same.

6. A terminal end structure according to claim 5, wherein said tongue and said indented portion have a substantially rectangular shape.

* * * * *